US008430270B2

(12) United States Patent
Chen et al.

(10) Patent No.: US 8,430,270 B2
(45) Date of Patent: Apr. 30, 2013

(54) GLUE DISPENSER

(75) Inventors: Chun-Ming Chen, Tu-Cheng (TW); Li Chen, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 233 days.

(21) Appl. No.: 12/868,700

(22) Filed: Aug. 25, 2010

(65) Prior Publication Data

US 2011/0049186 A1 Mar. 3, 2011

(30) Foreign Application Priority Data

Aug. 27, 2009 (CN) ..... 2009 1 0306148

(51) Int. Cl.
*B67D 7/80* (2010.01)

(52) U.S. Cl.
USPC ..... 222/146.6; 222/394; 165/185

(58) Field of Classification Search ..... 222/146.6, 222/146.5, 146.1, 394, 389; 118/302, 641; 126/401; 156/578; 165/80.3, 185
See application file for complete search history.

(56) References Cited

U.S. PATENT DOCUMENTS 7,111,666 B2 * 9/2006 Zeighami et al. ..... 165/80.3

FOREIGN PATENT DOCUMENTS

| | | | | |
|---|---|---|---|---|
| CN | 101380621 A | | 3/2009 | |
| JP | 6-106119 A | | 4/1994 | |
| JP | 06106119 | * | 4/1994 | ..... 118/302 |
| JP | 2001-232264 A | | 8/2001 | |
| JP | 2004-237196 A | | 8/2004 | |
| JP | 2004237196 | * | 8/2004 | |

* cited by examiner

*Primary Examiner* — Kevin P Shaver
*Assistant Examiner* — Leslie Tanner
(74) *Attorney, Agent, or Firm* — Altis Law Group, Inc.

(57) ABSTRACT

A glue dispenser includes an injector, a controller, a gas conduit and a dispensing head. The injector includes a glue conduit and a heat sink assemble. The controller controls a gas volume input to the glue conduit. The gas conduit is connected with the controller and the injector. The dispensing head is connected with the glue conduit for dispensing glue. The heat sink assemble defines a through hole connecting the gas conduit and the glue conduit. The glue dispenser maintains the glue conduit at a stable temperature.

18 Claims, 4 Drawing Sheets

GLUE DISPENSER

BACKGROUND

1. Technical Field

The present disclosure relates to manufacturing, and particularly to glue dispensers used in manufacturing.

2. Description of Related Art

Glue dispensers used in the manufacturing of PCBs, for example, can include: a controller for regulating the volume of a gas for dispensing; a glue material conduit receiving the glue material; a gas conduit transmitting the dispensing gas from the controller to the glue material conduit; and a dispensing head dispensing glue material. In a typical design of the glue dispenser, the dispensing head is received in the glue material conduit. However, a temperature of the glue material conduit gradually rises during use. This increase in temperature of the glue material conduit can de-stabilize dispensing volume of the glue material.

What is needed is a glue dispenser that can overcome the described limitations.

BRIEF DESCRIPTION OF THE DRAWINGS

The components of the drawings are not necessarily drawn to scale, the emphasis instead being placed upon clearly illustrating the principles of the embodiment of a glue dispenser. Moreover, in the drawings, like reference numerals designate corresponding parts throughout the views.

DETAILED DESCRIPTION

Figure 1:
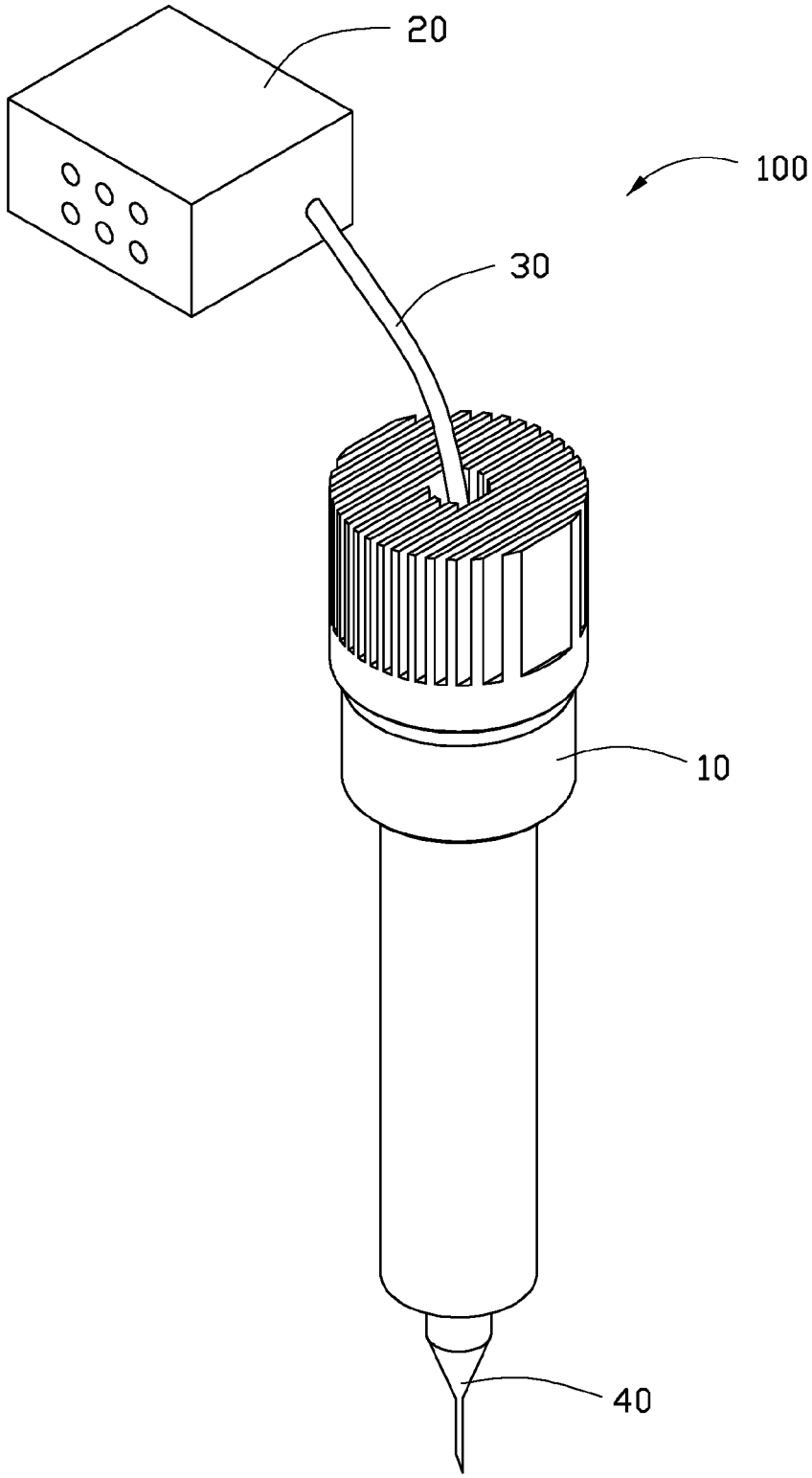
FIG. 1 is a schematic diagram of an exemplary embodiment of a glue dispenser.

Referring to FIG. 1, a schematic diagram of an exemplary embodiment of a glue dispenser 100 shows the glue dispenser 100 including an injector 10, a controller 20, a gas conduit 30, and a dispensing head 40. The injector 10 contains a certain volume of glue (not shown). The gas conduit 30 is connected with the controller 20 and the injector 10. The gas conduit 30 is inserted into one end of the injector 10 but not though the injector 10. The controller 20 is configured to control a volume of gas input to the injector 10 by passing the gas through the conduit 30. The volume of glue dispensed is controlled by the volume of the gas input to the injector 10 by the controller 20. The dispensing head 40 is disposed in the other end of the injector 10 to dispense the glue.

Figure 2:
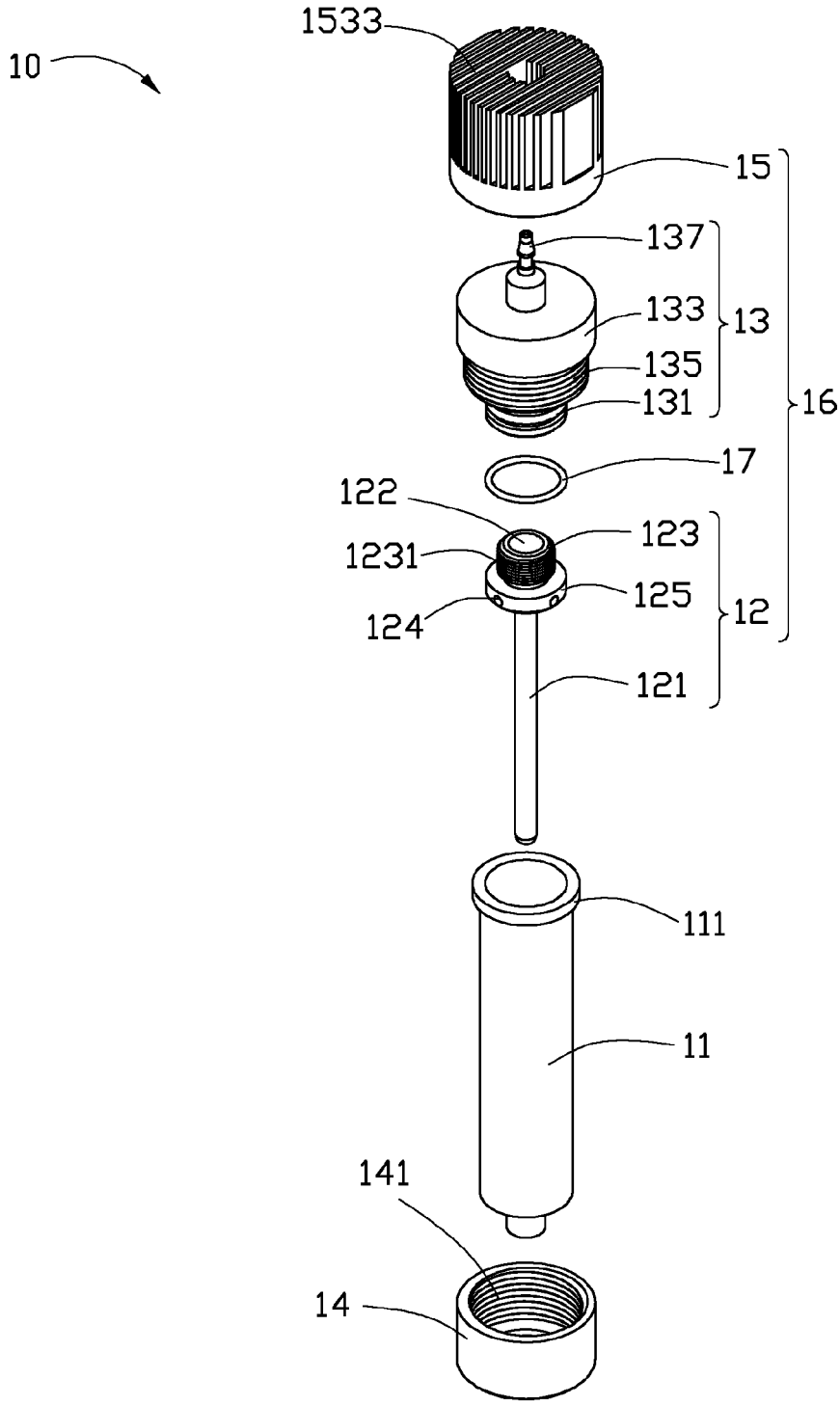
FIG. 2 is an isometric view of an injector of FIG. 1.
Figure 3:
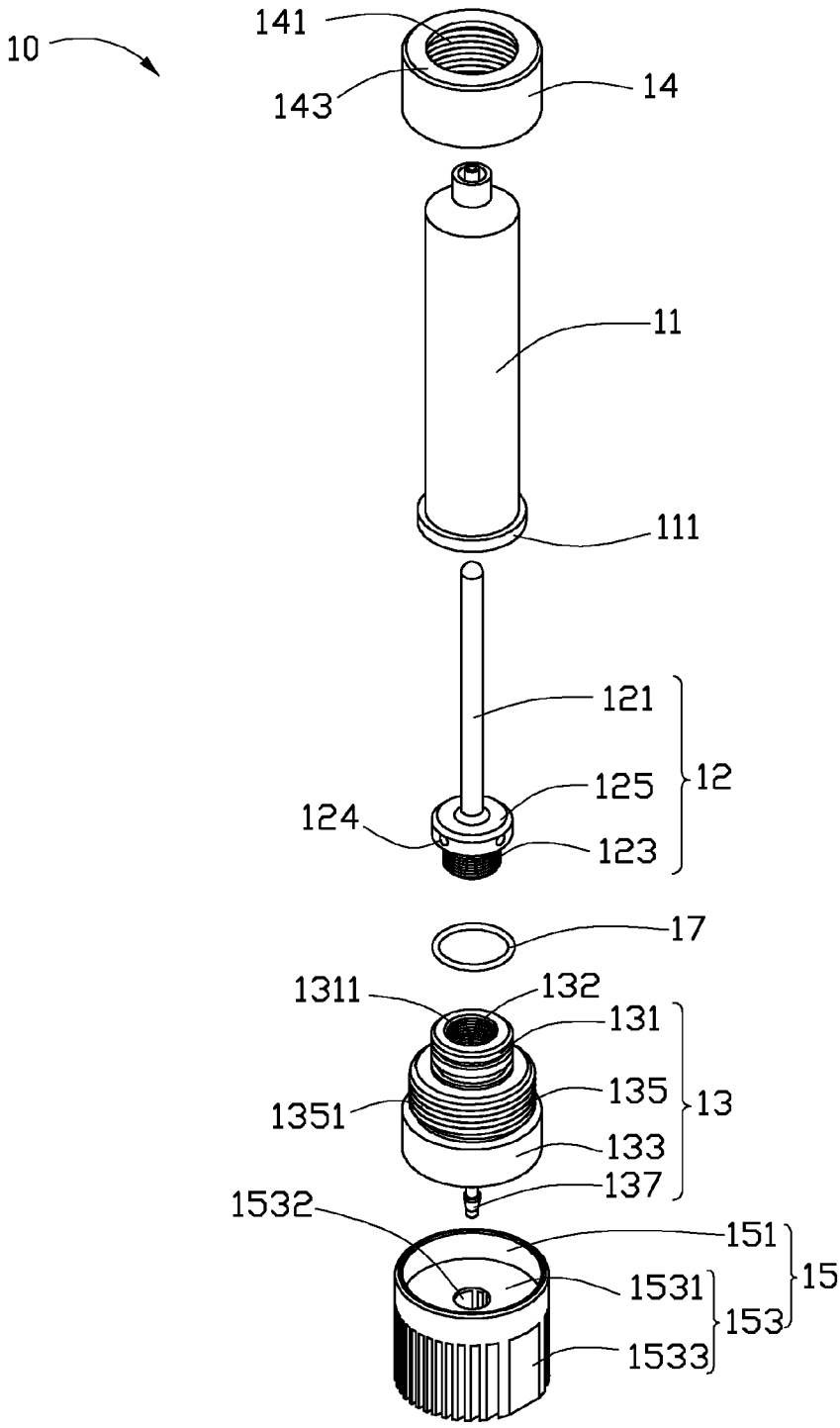
FIG. 3 is another isometric view of the injector of FIG. 1.

FIG. 2 and FIG. 3 are two corresponding isometric views of the injector 10 of the glue dispenser 100. The injector 10 includes a glue conduit 11, a heat sink assembly 16 and a fastening means 14. The fastening means 14 secures the heat sink assembly 16 to the glue conduit 11. The heat sink assembly 16 includes a first heat conductor 12, a second heat conductor 13, an O-ring 17 and a heat sink 15. The first heat conductor 12, the second heat conductor 13 and the heat sink 15 are thermal conductive material, such as copper, aluminum or copper alloy.

The glue conduit 11 is tubular and configured to receive a certain volume of glue. One end of the glue conduit 11 is securely connected with the dispensing head 40 and the other end of the glue conduit 11 defining an outer flange 111 on an outer surface of the glue conduit 11.

The first heat conductor 12 includes a heat conducting bar 121, a first fixing portion 123 and a connecting portion 125. The connecting portion 125 is disposed between the heat conducting bar 121 and the first fixing portion 123. The heat conducting bar 121 is disposed within the glue conduit 11 and contacts the glue contained in the glue conduit 11. The heat conducting bar 121 can transfer the heat of glue contained in the glue conduit 11. The first fixing portion 123 defines an outer fastener 1231 on a surface of the first fixing portion 123 and further defines a first gas flow hole 122 vertically passing through the first fixing portion 123. The connecting portion 125 is disposed within the glue conduit 11 and an outside diameter of the connecting portion 125 is less than an inside diameter of the glue conduit 11. The connecting portion 125 defines a plurality of second gas flow holes 124 along the axis of the connecting portion 125. The plurality of second gas flow holes 124 communicates with the first gas flow hole 122.

One end of the second heat conductor 13 is a gas input through hole 132. The second heat conductor 13 includes a closed portion 131, a conductor portion 133, and a second fixing portion 135. The second fixing portion 135 is disposed between the closed portion 131 and the conductor portion 133 and a gas input through conduit 137 is disposed in a distal end of the conductor portion 133. The gas input through hole 132 extends from the closed portion 131 to the conductor portion 133. The gas input through hole 132 passes through the second fixing portion 135 and connects to the gas input through conduit 137. The closed portion 131 defines an inner fastener 1311 in an inside surface of the closed portion 131. The inner fastener 1311 is configured for fixing an outer fastener 1231 of the first fixing portion 123. An outside diameter of the closed portion 131 matches an inside diameter of the glue conduit 11. The closed portion 131 is receivable in the glue conduit 11. The second fixing portion 135 defines an outer fastener 1351 on the outer surface of the second fixing portion 135.

The O-ring 17 is seated around the closed portion 131.

The fastening means 14 is a sleeve. An inner fastener 141 is defined on an inner surface of the fastening means 14 and fixed with the outer fastener 1351 of the second fixing portion 135. The fastening means 14 can fasten with the second fixing portion 135. The fastening means 14 defines an inner flange 143 on the inner surface of one end. The fastening means 14 slides from the end of dispensing head 40 to the end of an outer flange 111 of the glue conduit 11. The outer flange 111 and the inner flange 143 abut each other. The fastening means 14 can fasten the second heat conductor 13 with the glue conduit 11.

The heat sink 15 includes a third fixing portion 151 and a heat conducting portion 153 connected with the third fixing portion 151. The third fixing portion 151 is in the sleeve form and coiled around the conductor portion 133. The third fixing portion 151 can securely connect the heat sink 15 with the second heat conductor 13. The heat conducting portion 153 includes a connecting plate 1531 and a plurality of heat conducting fins 1533. The connecting plate 1531 is connected to one end of the third fixing portion 151 and the heat conducting fins 1533 are disposed on the connecting plate 1531. A through hole 1532 is defined in a center of the connecting plate 1531 and receives the gas input through conduit 137. The gas input through conduit 137 passes through the through hole 1532 of the connecting plate 1531 to connect with the gas conduit 30 and the glue conduit 11.

Figure 4:
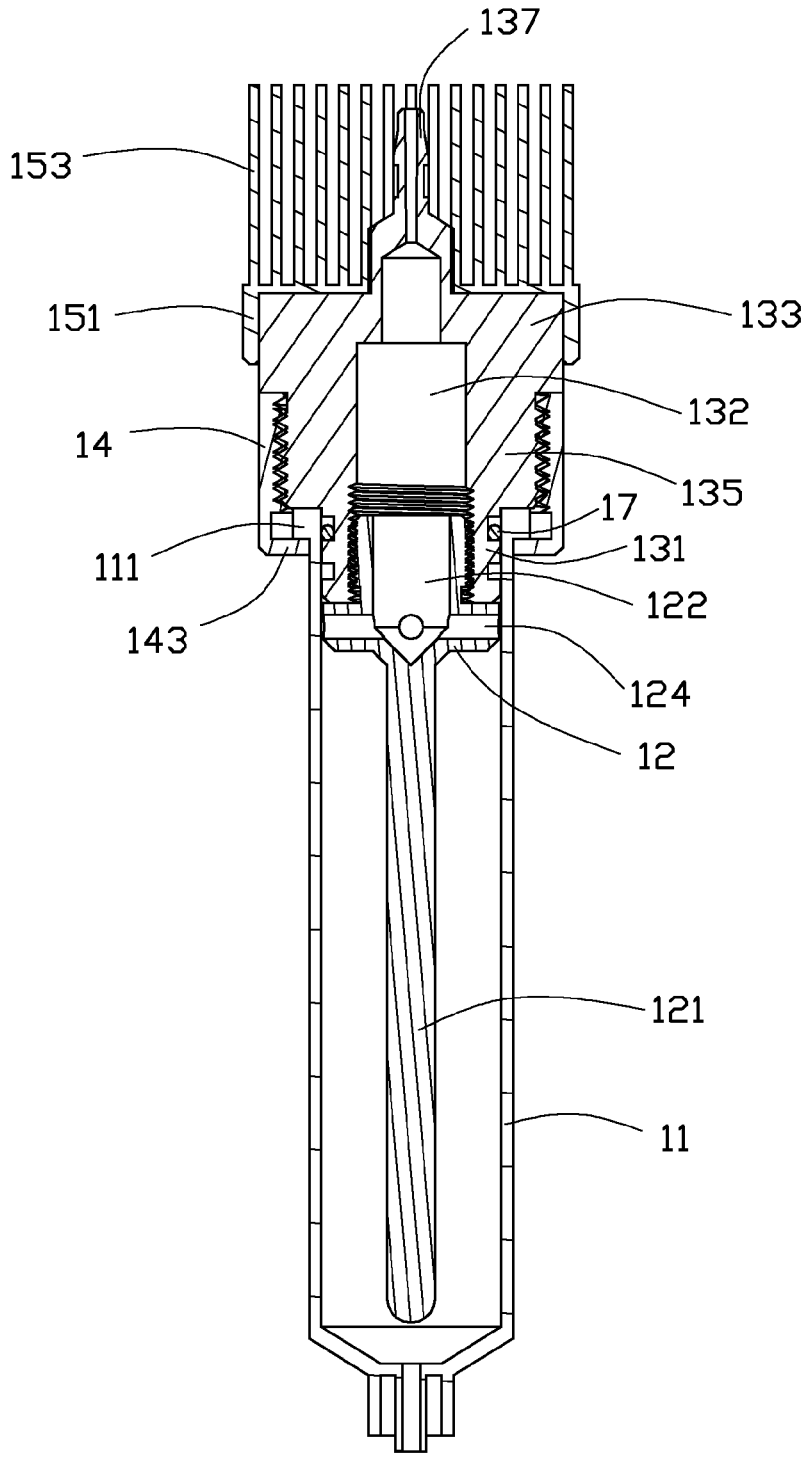
FIG. 4 is a partial cross-section of an assembly injector of FIG. 1.

In assembly, glue is loaded into the glue conduit 11. The first gas flow hole 122 connects the conductor portion 132 by fixing the first fixing portion 123 of the first heat conductor 12 to the closed portion 131 of the second heat conductor 13. The first heat conductor 12 is received in the glue conduit 11 from the end of outer flange 111. The O-ring 17 is coiled around the closed portion 131 and prevents glue from escaping the glue conduit 11. The closed portion 131 is received in the glue conduit 11 with the first heat conductor 12. The second gas flow holes 124 are connected with a cavity of the glue conduit 11. The fastening means 14 slides from the end of dispensing head 40 to the end of the outer flange 111 of the glue conduit 11. The fastening means 14 is fixed with the second fixing portion 135. The third fixing portion 151 is anchored at the second heat conductor 13. The gas input through conduit 137 passes through the through hole 1532 of the connecting plate 1531 to connect with the gas conduit 30. A partial cross-section of a final assembly injector 10 is shown in FIG. 4.

After connection, gas can enter the glue conduit 11 by passing through the gas conduit 30, the gas input through conduit 137, gas input through hole 132, the first gas flow hole 122 and the second gas flow holes 124. The glue dispenser 100 can control the gas volume inputted into the glue conduit 11 by the controller 20 and the volume of dispensing glue of the dispensing head 40. The heat of the glue conduit 11 in the dispensing procedure is transferred from the first heat conductor 12 to the second heat conductor 13 and finally dissipated by the heat conducting fins 1533 of the heat sink 15. The first heat conductor 12, the second heat conductor 13 and the heat sink 15 are heat conductive material. Thus, the temperature of glue conduit 11 is stabilized and allows dispensing head 40 to maintain a consistent dispensing volume.

It is to be understood, however, that even though numerous characteristics and advantages of the present disclosure have been set forth in the foregoing description, together with details of the structure and function of the disclosure, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A glue dispenser, comprising:

an injector including a glue conduit and a heat sink assembly;

a controller configured to control a volume of gas input to the glue conduit;

a gas conduit connected with the controller and the injector; and a dispensing head connected with the glue conduit;

wherein the heat sink assembly defines a through hole connecting the gas conduit and the glue conduit, the heat sink assembly comprises a first heat conductor, a second heat conductor, an O-ring and a heat sink, wherein the first heat conductor is received in the glue conduit, the second heat conductor is fastened in the first heat conductor, and the heat sink is fastened to the second heat conductor.

2. The glue dispenser of claim 1, wherein the first heat conductor comprises a heat conducting bar, a first fixing portion and a connecting portion disposed between the heat conducting bar and the first fixing portion.

3. The glue dispenser of claim 2, wherein the first fixing portion further defines a first gas flow hole.

4. The glue dispenser of claim 3, wherein the connecting portion further defines a plurality of second gas flow holes communicating with the first gas flow hole.

5. The glue dispenser of claim 1, wherein the second heat conductor further comprises a closed portion, a conductor portion, and a second fixing portion disposed between the closed portion and the conductor portion, the closed portion is receivable in the glue conduit.

6. The glue dispenser of claim 1, wherein the heat sink further comprises a plurality of heat conducting fins.

7. The glue dispenser of claim 1, wherein heat sink is heat conductive material.

8. The glue dispenser of claim 7, wherein the heat conductive material is copper or aluminum.

9. The glue dispenser of claim 7, wherein the heat conductive material is a copper alloy.

10. A glue dispenser, comprising:

an injector comprising a glue conduit and a heat sink assembly;

a controller configured to control a volume of gas input to the glue conduit;

a gas conduit connected with the controller and the injector; and a dispensing head connected with the glue conduit;

wherein the heat sink assembly comprises a heat conductor and a heat sink connected to the heat conductor, the heat in the glue conduit is transferred to the heat sink via the heat conductor, the heat sink disperses the heat, the heat conductor comprises a first heat conductor and second heat conductor connected to the first heat conductor, the second heat conductor is secured to the heat sink, the first heat conductor is received in the glue conduit.

11. The glue dispenser of claim 10, wherein the second heat conductor comprising a closed portion connected to one end of the first heat conductor and received in the glue conduit, the heat sink assembly further comprising a rubber seat around the closed portion to prevent the gas to leak from the glue conduit.

12. The glue dispenser of claim 11, wherein the rubber seat is an O ring.

13. The glue dispenser of claim 11, wherein the second heat conductor further comprising a fixing portion, the injector further includes a fastening means slidably secured on the glue conduit, the fastening means is secured to the fixing portion to fasten the second heat conductor to the glue conduit.

14. A glue dispenser, comprising:

an injector comprising a glue conduit and a heat sink assembly; and a dispensing head connected with the glue conduit;

wherein the injector further comprises a through hole communicating with the injector to enable a volume of gas to pass to the glue conduit, the glue conduit is configured to receive glue, a part of the heat sink assembly is inserted into the glue conduit to release heat of the glue conduit.

15. The glue dispenser of claim 14, wherein the through hole is defined in the heat sink assembly.

16. The glue dispenser of claim 15, wherein the heat sink assembly comprises a first heat conductor, a second heat conductor, and a heat sink, the first heat conductor is inserted into the glue conduit, the second heat conductor and the heat sink is positioned at the outside of the glue conduit, the second heat conductor is connected between the first heat conductor and the heat sink.

17. The glue dispenser of claim 16, wherein the through hole comprising an input through hole passes through the second heat conductor, a first gas flow hole defined in the first heat conductor communicating with the input through hole, and at least one second gas flow hole defined in the first heat conductor communicating with the first gas flow hole and the glue conduit.

18. The glue dispenser of claim 17, wherein the first gas flow hole is concentric with the input through hole, the at least one second gas flow hole has a center line being perpendicular with a center line of the first gas flow hole.

* * * * *